US010859325B2

(12) United States Patent
Kimura

(10) Patent No.: US 10,859,325 B2
(45) Date of Patent: Dec. 8, 2020

(54) HEAT EXCHANGER

(71) Applicant: NEO CORPORATION, Chiba (JP)

(72) Inventor: Yoichi Kimura, Chiba (JP)

(73) Assignee: NEO CORPORATION, Chiba (JP)

( * ) Notice: Subject to any disclaimer, the term of this patent is extended or adjusted under 35 U.S.C. 154(b) by 0 days.

(21) Appl. No.: 15/545,575

(22) PCT Filed: Jun. 27, 2016

(86) PCT No.: PCT/JP2016/003080
§ 371 (c)(1),
(2) Date: Jul. 21, 2017

(87) PCT Pub. No.: WO2018/002963
PCT Pub. Date: Jan. 4, 2018

(65) Prior Publication Data

US 2019/0107337 A1 Apr. 11, 2019

(51) Int. Cl.

| | |
|---|---|
| ***F28F 3/12*** | (2006.01) |
| ***F28F 3/06*** | (2006.01) |
| ***F24H 1/12*** | (2006.01) |
| ***F24H 9/18*** | (2006.01) |

(52) U.S. Cl.
CPC ..... *F28F 3/06* (2013.01); *F24H 1/121* (2013.01); *F24H 9/1818* (2013.01); *F28F 3/12* (2013.01); *F28F 2265/26* (2013.01)

(58) Field of Classification Search
CPC . F28F 3/06; F28F 3/12; F28F 2265/26; F24H 1/121; F24H 9/1818
See application file for complete search history.

(56) References Cited

U.S. PATENT DOCUMENTS 5,351,889 A * 10/1994 Whiteside ..... B05B 1/34 239/132
5,899,077 A 5/1999 Wright et al.
6,821,625 B2 * 11/2004 Chu ..... H01L 23/373 174/16.3
7,900,800 B2 * 3/2011 Hassler, Jr. ..... F16N 25/00 222/146.5

(Continued)

FOREIGN PATENT DOCUMENTS

JP 54-69445 U 5/1979
JP 2000-193383 A 7/2000

(Continued)

*Primary Examiner* — Filip Zec
(74) *Attorney, Agent, or Firm* — Norris McLaughlin, P.A.

(57) ABSTRACT

A heat exchanger comprises a body having a passage through which fluid to be heat-exchanged passes, a heat transfer plate conducting heat exchange relative to the fluid to be heat-exchanged through the body. The heat transfer plate is provided with a plate body having a contact face that contacts an outer surface of the body, and a plurality of wall-shaped heat conductors being protruded from the contact face of the plate body and arranged inside the body. The body is provided with a plurality of slit-shaped holes into which the plurality of wall-shaped heat conductors are inserted and fitted at positions avoiding the passage, respectively, thereby to cause the heat conductors to be arranged inside the body. Each one heat conductor is formed smaller than a hole fitted to define a gap relative to said hole fitted.

9 Claims, 11 Drawing Sheets

(56) References Cited

U.S. PATENT DOCUMENTS

| | | | | |
|---|---|---|---|---|
| 8,607,694 | B2 * | 12/2013 | Blanc | H05B 3/50 99/323.3 |
| 9,080,795 | B2 * | 7/2015 | Lee | F24D 12/02 |
| 2003/0173062 | A1 * | 9/2003 | Lomax, Jr. | B01J 8/008 165/82 |
| 2006/0102744 | A1 * | 5/2006 | Arkasjevski | F28F 3/12 239/128 |
| 2013/0112386 | A1 | 5/2013 | Lai et al. | |
| 2015/0159958 | A1 | 6/2015 | Kimura | |
| 2017/0215302 | A1 * | 7/2017 | Totani | H05K 7/20509 |

FOREIGN PATENT DOCUMENTS

| | | | |
|---|---|---|---|
| JP | 2001-056197 | A | 2/2001 |
| JP | 2006134989 | A | 5/2006 |
| JP | 2008232597 | A | 10/2008 |
| JP | 2015152218 | A | 8/2015 |
| JP | 2015152219 | A | 8/2015 |
| TW | 201319507 | A | 5/2013 |
| TW | 201408983 | A | 3/2014 |
| WO | 2013180047 | A1 | 1/2016 |

* cited by examiner

FIG.10(A)

FLOW RATE 10L/min

| | | | | | | |
|---|---|---|---|---|---|---|
| | PRESET TEMPERATURE (°C) | 100 | 200 | 300 | 400 | 500 |
| EMBODIMENT 1 | OUTLET TEMPERATURE (°C) | 96 | 190 | 294 | 393 | 483 |
| COMPARATIVE EXAMPLE | OUTLET TEMPERATURE (°C) | 93 | 185.4 | 279.4 | 371 | |
| EMBODIMENT 1 | HEAT CONVERSION RATE (%) | 96 | 95 | 98 | 98.3 | 96.6 |

FIG.10(B)

FLOW RATE 1L/min

| | | | | | | |
|---|---|---|---|---|---|---|
| | PRESET TEMPERATURE (°C) | 100 | 200 | 300 | 400 | 500 |
| EMBODIMENT 1 | OUTLET TEMPERATURE (°C) | 97 | 188 | 280 | 371 | 473 |
| COMPARATIVE EXAMPLE | OUTLET TEMPERATURE (°C) | 80 | 143 | 203 | 354 | |
| EMBODIMENT 1 | HEAT CONVERSION RATE (%) | 97 | 94 | 93.3 | 92.8 | 94.6 |

HEAT EXCHANGER

FIELD OF THE INVENTION

The present invention relates to a heat exchanger to control temperature of

BACKGROUND OF THE INVENTION

A heat exchanger is a device in which two objects having different temperatures contact with each other to heat or cool one of the objects and control the temperature and is widely industrially used for a boiler, a steam generator, food manufacture, chemical manufacture, refrigeration storage or the like.

When controlling temperature of fluid, for example, a head exchanger is provided on the way of pipe arrangement to control the temperature of the fluid flowing in the pipe arrangement.

As such kind of a conventional heat exchanger, there is disclosed in WO2013/180047, for example. In this heat exchanger, a passage communicating with pipe arrangement is formed in a plate-like body, cylindrical pin heat conductors having heat conductivity better than of the body are buried around the passage, and a heat transfer plate and a heater plate are laid on each side of the body.

With this, fluid to be heat-exchanged in the passage is heated by the heater plates through the heat transfer plates and the body and then the heat conductors improve the heat conductivity, thereby to realize high heat exchange efficiency.

In the conventional heat exchanger, however, the cylindrical pin heat conductor is fitted and attached into a hole formed in the body without a gap in view of the heat exchange efficiency. Thus, thermal expansion difference between the heat conductors and the body may not be absorbed according to material of the heat conductors and the body, thereby to cause cracks in the passage due to stress.

SUMMARY OF THE INVENTION

A problem to be solved is that, in a structure in which heat conductor is fitted into a hole of a body of a heat exchanger, thermal expansion difference between the heat conductor and the body may not be absorbed unless heat exchange efficiency is reduced, thereby to cause cracks in the passage.

The present invention provides a heat exchanger, capable of, in a structure in which a heat conductor is fitted into a hole of a body of the heat exchanger, absorbing thermal expansion difference between the heat conductor and the body without reduction of heat exchange efficiency. The heat exchanger is provided with a body having a passage through which fluid to be heat-exchanged passes, a heat transfer member conducting heat exchange relative to the fluid to be heat-exchanged through the body, the heat transfer member being provided with a member body having a contact face that contacts an outer surface of the body, and a plurality of wall-shaped heat conductors being protruded from the contact face of the member body and arranged inside the body, the body being provided with a plurality of slit-shaped holes into which the plurality of wall-shaped heat conductors are inserted and fitted at positions avoiding the passage, respectively, thereby to cause the heat conductors to be arranged inside the body, and wherein each one heat conductor is formed smaller than a hole fitted, to define a gap relative to said hole fitted.

The heat exchanger according to the present invention, in a structure in which the heat conductor is fitted into the hole of the body of the heat exchanger, absorbs thermal expansion difference between the heat conductor and the body using the gap and prevents cracks from being generated in the passages. Further, the heat conductor is wall-shaped to prevent reduction of heat exchange efficiency even if the heat conductor is smaller than the hole.

BRIEF DESCRIPTION OF THE DRAWINGS

FIGS. 6(A) and (B) illustrate a body used in the heat exchanger of FIG. 3 in which FIG. 6(A) is a bottom view and FIG. 6(B) is a sectional view taken along a line VI-VI of (A);

FIGS. 7(A) and (B) illustrate a heat transfer plate used in the heat exchanger of FIG. 3 in which FIG. 7(A) is a bottom view and FIG. 7(B) is a side view;

FIGS. 8(A) and (B) illustrate a relationship between a hole of the body and a heat conductor of the heat transfer plate of the heat exchanger of FIG. 3 in which FIG. 8(A) is a plan view and FIG. 8(B) is a sectional view;

FIGS. 10(A) and (B) are tables illustrating outlet temperatures of the embodiment 1 and a comparative example relative to a preset temperature of fluid to be heat-exchanged by comparison, in which FIG. 10(A) is a case of a flow rate of the fluid to be heat-exchanged being 10 L/min and FIG. 10(B) is a case of the flow rate being 1 L/min;

FIG. 13 are graphs illustrating response during heating according to the embodiment 1, in which

DETAILED DESCRIPTION OF EMBODIMENTS

The object that, in a structure in which a heat conductor is fitted into a hole of a body of a heat exchanger, is to absorb thermal expansion difference between the heat conductor and the body without reduction of heat exchange efficiency is accomplished by making heat conductors wall-shaped, holes of the body slit-shaped, and the heat conductors formed smaller than the holes.

In particular, the heat exchanger is provided with the body having a passage through which fluid to be heat-exchanged passes, and a heat transfer member conducting heat exchange relative to the fluid to be heat-exchanged through the body. The heat transfer member is provided with a member body having a contact face that contacts an outer surface of the body, and a plurality of the wall-shaped heat conductors being protruded from the contact face of the member body and arranged inside the body. The body is provided with a plurality of the slit-shaped holes into which the plurality of wall-shaped heat conductors are inserted and fitted at positions avoiding the passage, respectively, thereby to cause the heat conductors to be arranged inside the body. Each one heat conductor is formed smaller than a hole fitted, to define a gap relative to said hole fitted.

Basically, the heat conductor is formed shorter than the hole in a dimension in an inserting direction to define the gap. The heat conductor, however, may be made smaller in a sectional shape in a direction intersecting the inserting direction.

The holes may be provided so as to pass completely through the body and a pair of the heat transfer members may be provided across the body so that mutually corresponding heat conductors are inserted into the hole from both sides to define the gap between said mutually corresponding heat conductors. Only one heat transfer member, however, may be provided. In this case, there is no need for the holes to be formed so as to go through the body.

The heat conductors may be formed integrally with the member body. The heat conductors, however, may be formed separately from the member body and a contact face of the member body may be configured to contact the heat conductors.

The passage may be provided with parallel paths arranged in parallel and turning paths having a turning-back shape and connecting the parallel paths, and the heat conductors may be arranged along and between the parallel paths of the passage.

The turning path may have a bent shape with an angle on an inside of the turning-back shape.

Further, the turning path may have a curved shape with no angle on an outside of the turning-back shape.

Figure 1:
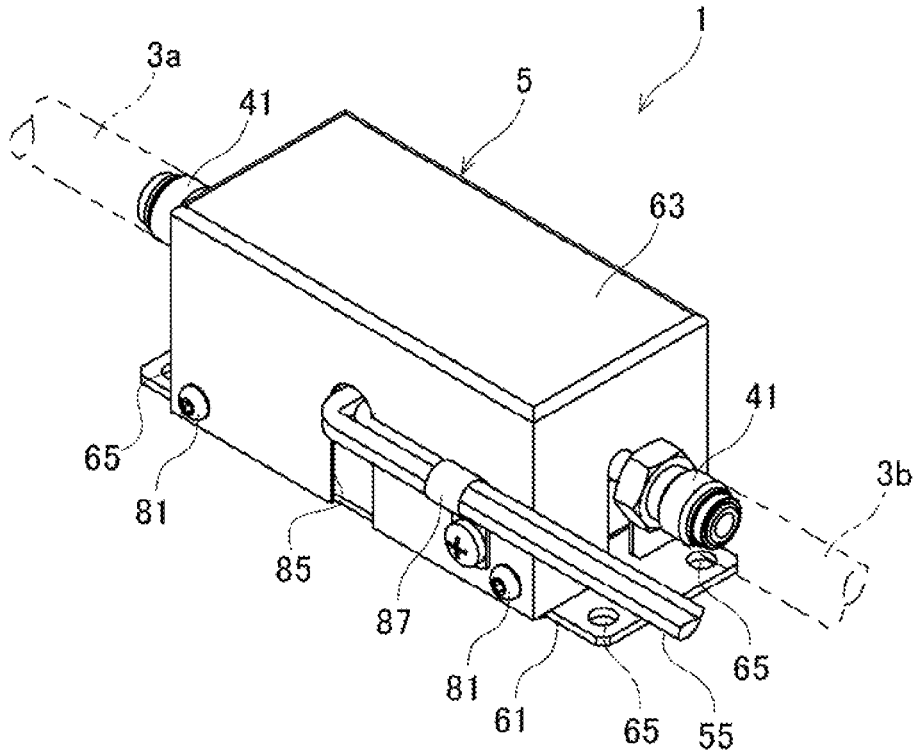
FIG. 1 is a perspective view of a heat exchanging unit having a heat exchanger according to an embodiment 1 of the present invention.
Figure 2:
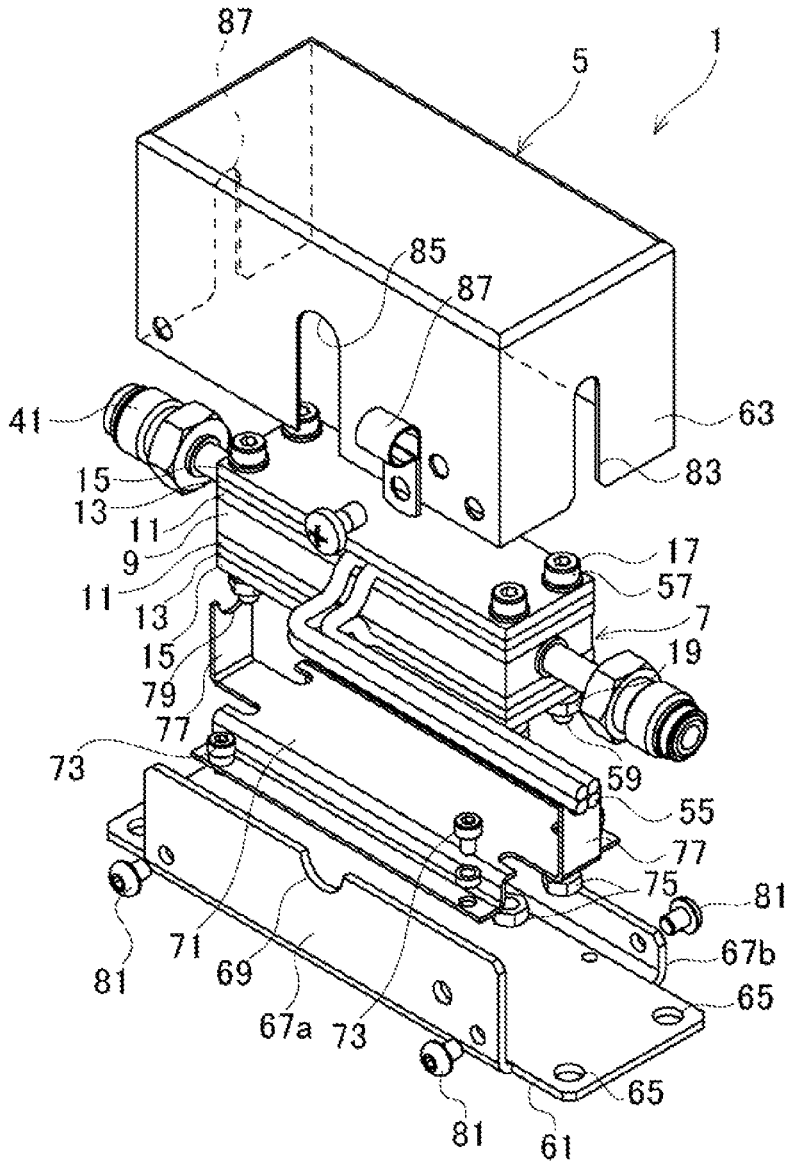
FIG. 2 is an exploded perspective view of the heat exchanging unit of FIG. 1.

FIG. 1 is a perspective view of a heat exchanging unit with a heat exchanger according to the embodiment 1 of the present invention and FIG. 2 is an exploded perspective view of the same heat exchanging unit.

The heat exchanging unit 1 of this embodiment is provided on the way of pipe arrangement 3*a*, 3*b* through which fluid to be heat-exchanged passes and is used in, for example, a fixed state to a wall or the like. The heat exchanging unit 1 makes the fluid to be heat-exchanged flowed in from the upstream laying pipe 3*a* pass through its inside and flow out to the downstream laying pipe 3*b*. At this time, the heat exchanging unit 1 heats or cools the fluid to be heat-exchanged to conduct temperature control or temperature adjustment. According to this embodiment, the heat exchanging unit 1 heats the fluid to be heat-exchanged.

The fluid to be heat-exchanged is, for example, liquid or gas of corrosive acid such as hydrochloric acid, sulfuric acid, nitric acid, chromic acid, phosphoric acid, hydrofluoric acid, acetic acid, perchloric acid, hydrobromic acid, fluorosilicic acid, or boric acid, alkali such as ammonia, kalium hydroxide, or sodium hydroxide, metal salt such as chlorinated silicon, in addition high-purity water, or the like, but is not limited particularly. Such fluid to be heat-exchanged is used as reactive raw material with respect to other substances or as chemical liquid of a reactive step such as etching liquid, and is controlled by the heat exchanging unit 1 to appropriate temperature when used.

The heat exchanging unit 1 of this embodiment is configured by accommodating a heat exchanger 7 in a case 5. When accommodating the heat exchanger 7 in the case 5, a heat insulator (not illustrated) is wound around the heat exchanger 7. It should be noted that the heat exchanger 7 may be solely used with absence of the case 5.

Figure 3:
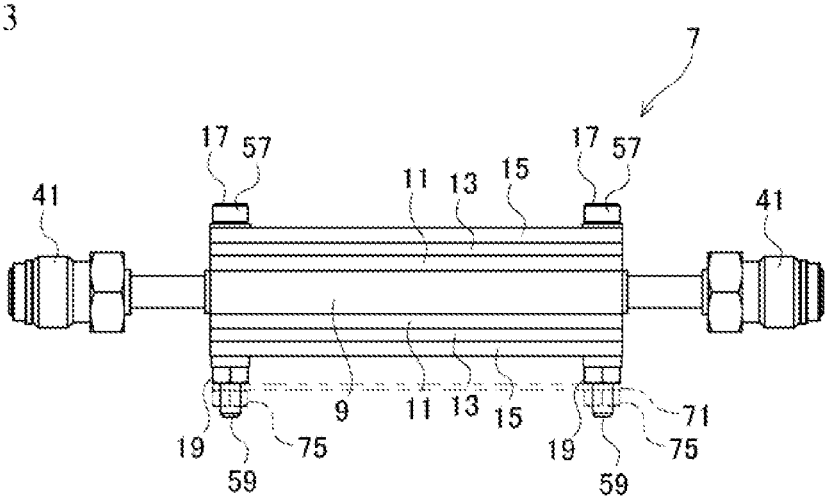
FIG. 3 is a side view of the heat exchanger used in the heat exchanging unit of FIG. 1.
Figure 4:
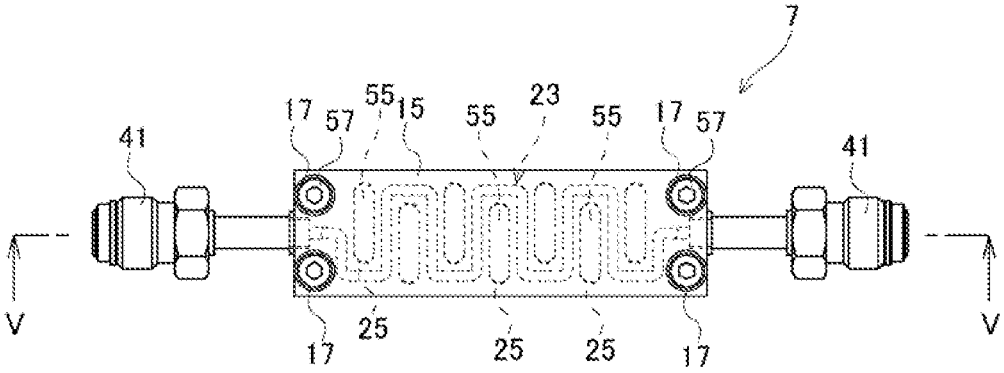
FIG. 4 is a plan view of the heat exchanger of FIG. 3.
Figure 5:
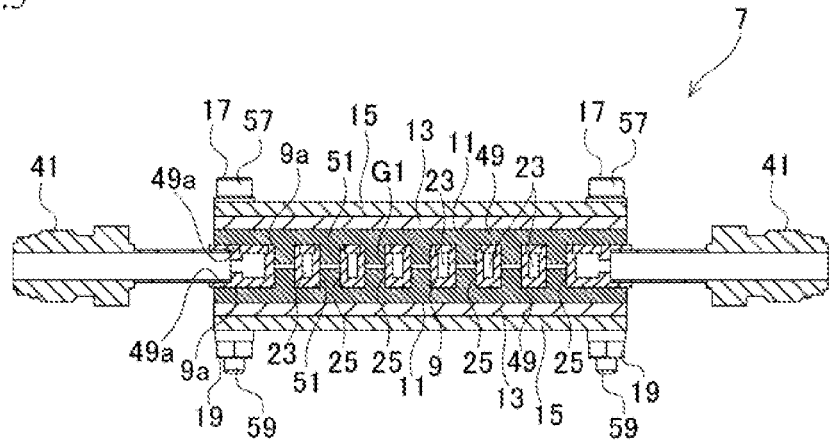
FIG. 5 is a sectional view taken along a line V-V of FIG. 4.

FIG. 3 is a side view of the heat exchanger 7 used in the heat exchanging unit 1 of FIG. 1, FIG. 4 is a plan view of the same, and FIG. 5 is a sectional view taken along a line V-V of FIG. 4.

As illustrated in FIGS. 3-5, the heat exchanger 7 is provided with a body 9, a pair of heat transfer plates 11, a pair of heater plates 13, and a pair of retaining plates 15. The heat transfer plate 11, the heater plate 13, and the retaining plate 15 are laid on one another in this order on each side of the body 9 and are fastened by bolts 17 and nuts 19 as a whole.

FIGS. 6(A) and (B) illustrate the body 9 used in the heat exchanger 7 of FIG. 3 in which FIG. 6(A) is a plan view and FIG. 6(B) is a sectional view taken along a line VI-VI of (A).

Figure 6:
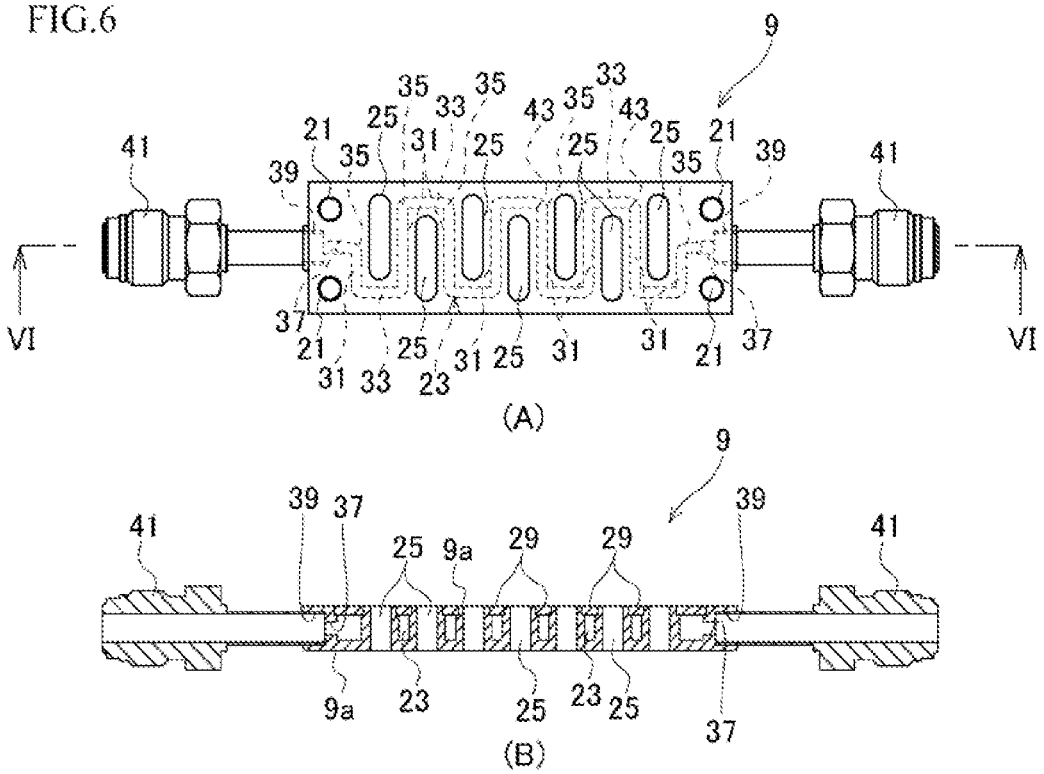

As illustrated in FIGS. 5 and 6, the body 9 is formed into a plate having a rectangular plan shape. At four corners of the body 9, fastening holes 21 are formed so as to pass completely through the body in a thickness direction. Material of the body 9 is stable material with respect to the fluid to be heat-exchanged. Namely, selected is material in which an inner surface of a passage 23 of the body 9 explained later does not react with the fluid to be heat-exchanged or components are not liquated from the inner surface of the passage 23 in a temperature range within which heat exchange is conducted.

Reactivity (corrosiveness) of the fluid to be heat-exchanged varies according to the material of the inner surface of the passage 23, contact temperature and the like, and an allowable range of purity after heat exchange varies also according to use and characteristics of the fluid to be heat-exchanged. The reactivity, therefore, cannot be completely identified. For example, a highly pure substance is used for metal halide or an etching agent used in manufacturing of semiconductors, so that reduction of purity due to a heat exchanging process cannot be allowed. Usually, a heat exchanger for a turbine, however, does not matter change in purity of fluid to be heat-exchanged due to a heat exchanging processing.

According to this embodiment, it is appropriately selected and used for the material of the body 9 from among metal such as iron, carbon steel, stainless steel, aluminum and titan, synthetic resin such as fluorocarbon resin and polyester, ceramics, and the like.

In the body 9, the passage 23 and a plurality of holes 25 are formed. The passage 23 is to pass the fluid to be heat-exchanged therethrough and is formed into a closed cross section from one end to the other end in a longitudinal direction of the body 9. According to this embodiment, the passage 23 is formed into a recessed groove of which opening is closed by a lid 29. The passage 23 is formed on a first side of the body 9 by cutting, etching, or the like and the lid 29 is attached to the opening of the passage 23 by welding or the like. It should be noted that, though the lid 29 is made of the same material as the body 9, it may be made of different material.

The passage 23 of this embodiment is formed into a wave shape turned back a plurality of times between the ends of the body 9 in a plan view. In particular, the passage 23 is provided with parallel paths 31 arranged along a widthwise direction of the body 9 in parallel and turning paths 33 having a turning-back shape and connecting adjacent parallel paths 31.

The parallel paths 31 are arranged in the longitudinal direction of the body 9 with regular intervals. The parallel paths 31 at both ends are formed shorter than the other parallel paths 31 and communicate with connections 39 at both ends through bent portions 35 and communication passages 37 along the longitudinal direction. To the connections 39, joints 41 are attached to be connected to the laying pipes 3*a* and 3*b*, respectively.

Figure 9:
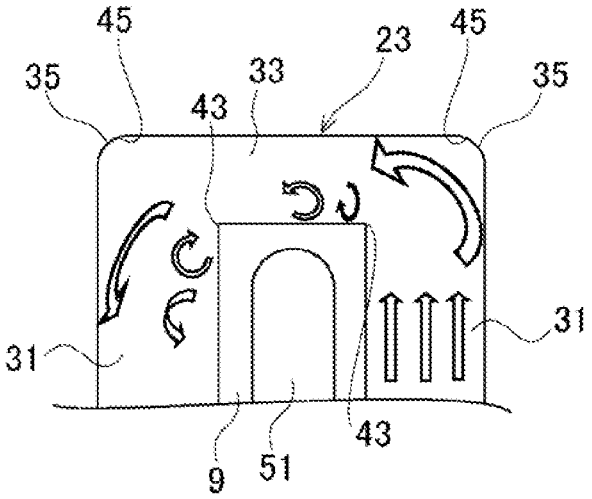
FIG. 9 is a conceptual view illustrating part of a passage formed in the body of the heat exchanger of FIG. 3.

The turning paths 33 are formed along the longitudinal direction of the body 9 and have bent portions 35 between the parallel paths 31 and the turning paths. The bent portion 35 has an angle 43 on an inside of the turning-back shape of the turning path 33 and has a curved face 45 with no angle on an outside of the turning-back shape (FIG. 9).

The turning path 33, therefore, generates turbulent flows in the fluid to be heat-exchanged on the downstream side of the bent portion 35 due to the angle 43, thereby to improve heat exchange efficiency. Namely, the fluid to be heat-exchanged becomes brisk in heat transfer between a low density portion and a high density portion and is allowed to efficiently conduct the heat transfer between the inner surface of the passage 23 and the fluid. Further, the turning path 33 prevents generation of excessive resistance being dependent on excessive turbulent flows due to the curved face 45 of the bent portion 43.

At positions avoiding the passage 23, the holes 25 are formed as illustrated in FIGS. 4-6. According to this embodiment, a plurality of the holes 25 are provided between the parallel paths 31 of the passage 23 so as to pass completely through the body 9 in the thickness direction and are configured so that heat conductors 51 explained later are inserted into the respective holes 25, respectively.

Each hole 25, in a plan view, is elongated in the widthwise direction of the body 9 from the inside of the turning path 33 of the passage 23 along the parallel paths 31 and is slit-shaped so that a dimension in the widthwise direction is greater than a dimension in the longitudinal direction of the body 9. Each end of the hole 25 is formed into an arc shape. It should be noted that there is need to prevent losing of strength, a function, and the like of the body 9 defining the hole 25 and the passage 23, but the nearer the distance between the hole 25 and the passage 23 the better.

Figure 7A:
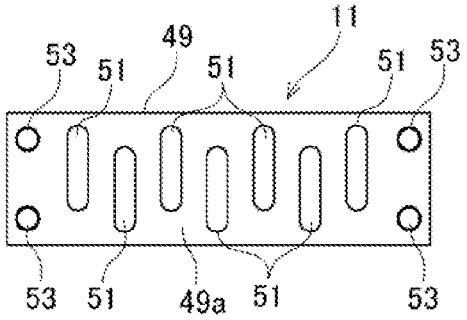
Figure 7B:
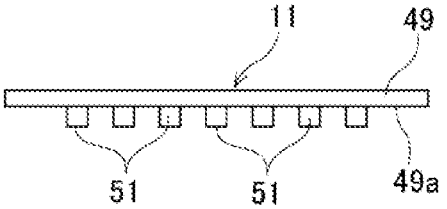
Figure 8A:
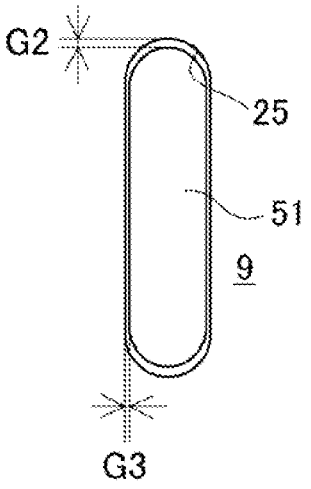
Figure 8B:
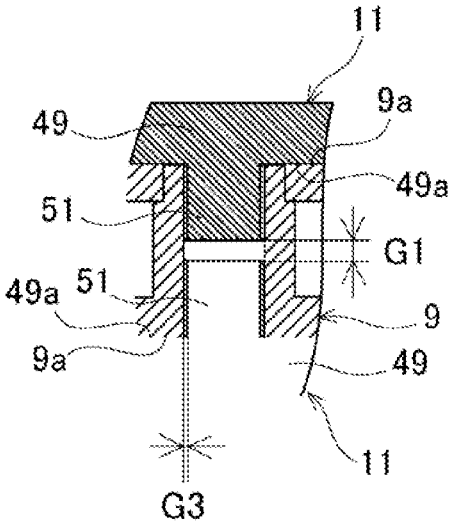

FIGS. 7(A) and (B) illustrate the heat transfer plate 11 in which FIG. 7(A) is a bottom view and FIG. 7(B) is a side view. FIGS. 8(A) and (B) illustrate a relationship between the hole of the body and the heat conductor of the heat transfer plate in which FIG. 8(A) is a plan view and FIG. 8(B) is a sectional view.

As illustrated in FIGS. 5 and 7, the pair of the heat transfer plates 11 are respective heat transfer members of this embodiment and conduct the heat exchange between the heat transfer plates and the fluid to be heat-exchanged through the body 9. Each heat transfer plate 11 is provided with a plate body 49 serving as a member body and the heat conductors 51. It should be noted that the pair of the heat transfer plates 11 have the same configuration and therefore only one of the plates will be explained basically.

The plate body 49 is formed into a plate having a rectangular planar shape corresponding to the body 9. The plate body 49 of this embodiment has a smaller thickness than the body 9. At four corners of the plate body 49, fastening holes 53 pass completely through the plate body in the thickness direction like the body 9.

Material of the plate body 49 is metal, synthetic resin, ceramics or the like having a higher heat conductivity than the body 9. In this plate body 49, a first side is a contact face 49*a* contacting an outer surface 9*a* of the body 9. On the contact face 49*a*, the plurality of the conductors 51 are provided.

The conductors 51 are wall-shaped to be protruded from the contact face 49*a* of the plate body 49 and arranged inside the body 9. The heat conductors 51 of this embodiment are formed integrally with the plate body 49 and is made of the same material as of the plate body 49. The heat conductors 51, therefore, are made of material having a higher heat conductivity than of the body 9. For example, the body 9 is made of stainless steel and the plate body 49 and the heat conductors 51 are made of aluminum.

It should be noted that the conductors 51 and the plate body 49 may be separately formed. In this case, the conductors 51 may be made of different material from of the plate body 49.

The heat conductors 51 are inserted into the respective holes 25 of the body 9 as mentioned above, thereby to be arranged inside the body 9. Each heat conductor 51 is formed smaller than the hole 25 into which the conductor is inserted. According to this embodiment, a dimension of the heat conductor in an inserting direction is shorter than of the hole to define a gap G1 within the hole 25 in the inserting direction as illustrated in FIG. 8(B). For more details, according to this embodiment, the body 9 is put between the pair of the heat transfer plates 11 of which mutually corresponding heat conductors 51 are inserted from both sides of the same hole 25 of the body 9 so that the gap G1 is defined between those mutually corresponding heat conductors 51. With this gap G1, it is possible to absorb the thermal expansion difference between the body 9 and the heat conductors 51.

Further, according to this embodiment, the heat conductor 51 is formed slightly smaller than the hole 25 of the body 9 in a cross section along an orthogonal direction with respective to the inserting direction in a plan view as illustrated in FIG. 8(A), thereby to have gaps G2 and G3 capable of absorbing the thermal expansion difference between the body 9 and the heat conductor 51 as well as the gap G1.

The gap G2 is a gap in the widthwise direction of the body 9 and the gap G3 is a gap in the longitudinal direction of the body 9. The gaps G2 and G3 are smaller than the gap G1 and the gap G3 is smaller than the gap G2. It should be noted that the gaps G2 and G3 may be omitted. Further, any one or both of the gaps G2 and G3 may be formed with the absence of the gap G1.

As illustrated in FIGS. 2, 3 and 5, the pair of the heater plates 13 are respective heat-generating elements of this embodiment and mica heaters. The heater plate 13, however, is not limited to the mica heater, but a ceramic heater such as an alumina heater or other heaters may be used. The pair of the heater plates 13 have the same configuration and therefore only one of the heater plates will be explained basically.

The heater plate 13 is formed into the same shape as the plate body 49 of the heat transfer plate 11. The heater plate 13, however, is smaller than the plate body 49 in thickness.

Setting of the thickness of the heater plate 13 is appropriately conducted according to capacity of the heater or the like.

To the heater plate 13, wires 55 is connected for power supply and generates heat up to a preset temperature according to electricity control. According to this embodiment, the heater plate 13 is laid on a second side of the heat transfer plate 11 to heat the fluid to be heat-exchanged in the passage 23 through the heat transfer plate 11 and the body 9. At four corner of the heater plate 13, fastening holes (not illustrated) are formed like the heat transfer plate 11 and the body 9.

It should be noted that a cooling plate may be used instead of the heater plate 13 if cooling of the fluid to be heat-exchanged is conducted. As the cooling plate, for example, a Peltier element using Peltier effect or the like may be used.

The pair of the retaining plates 15 each are formed of, for example, metal, synthetic resin, ceramics or the like into the same shape as the plate body 49 of the heat transfer plate 11. Four corner of the retaining plate 15, fastening holes (not illustrated) are formed like the heat transfer plate 11 and the like. These retaining plates 15 are laid on the heater plates S13 on both sides and are fastened by the bolts 17 and the nuts 19 in the outside of the layered structure of the heat exchanger 7.

The bolts 17 pass through the fastening holes 21, 53 or the like of the pair of the retaining plates 15, the pair of the heater plates 13, the pair of the heat transfer plates 11, and the body 9 so that head portions 57 are located on one of the retaining plates 15 and the nuts 19 are located on the other of the retaining plates 15 and are screwed to tips of male threaded portions 59.

As illustrated in FIGS. 1-3, the case 5 is configured by attaching a box-shaped part 63 on a plate base part 61. Material of the case 5 is not particularly limited, but it is metal such as stainless steel according to this embodiment.

The base part 61 is formed into a rectangular plate through which fixing holes 65 are formed. Using the fixing holes 65, the heat exchanging unit 1 is fixable to a wall or the like. Material of the base part 61 is metal or the like, in this embodiment stainless steel.

On both sides of the base part 61 in the widthwise direction, attaching plates 67*a* and 67*b* are raised for attaching the box-shaped part 63. One attaching plate 67*a* is formed higher than the other attaching plate 67*b*, and a recesses portion 69 is formed at an upper end of said one attaching plate to support the wires 55 of the heat exchanger 7.

On the base part 61, an intermediate plate 71 bent into a raised-bottom shape is attached by screws 73. The intermediate plate 71 is made of metal or the like, in this embodiment stainless steel, like the base part 61. On the intermediate plate 71, the heat exchanger 7 is mounted. According to this embodiment, the heat exchanger 7 is prevented from directly contacting the intermediate plate 71 using the bolts 17 and the nuts 19 fastening the body 9, the heat transfer plates 11, and the retaining plates 15 of the heat exchanger 7.

In particular, the nuts 19 contact the intermediate plate 71, the tips of the male threaded portions 59 of the bolts 17 protruding from the nuts 19 pass through the intermediate plate 71, and fixing nuts 75 are screwed to the tips of the male threaded portions 59.

On both sides of the intermediate plate 71 in a longitudinal direction, plate stand portions 77 are raised. On upper ends of the stand portions 77, recessed portions 79 are formed and the joints 41 of the heat exchanger 7 are put on and supported with the recessed portions 79.

In this state, the box-shaped part 63 is attached to the attaching plates 67*a* and 67*b* of the base part 61 by means of screws 81. The box-shaped part 63 is made of metal or the like, in this embodiment stainless steel, like the base part 61.

To the box-shaped part 63, slits 83 are formed to pass the joints 41 of the heat exchanger 7 therethrough and a slit 85 is formed to pass the wires 55 of the heat exchanger 7 therethrough. The wires 55 are led out from the slit 85 and thereafter are held by a clamp member 87 attached to a side face of the box-shaped part 63.

When adjusting the fluid to be heat-exchanged flowing in the laying pipes 3*a* and 3*b* to an intended temperature by means of the heat exchanging unit 1, the heater plates 13 of the heat exchanger 7 generate heat according to the electricity control first. When the heater plates 13 generate the heat, the heat is transferred to the heat transfer plates 11. From the heat transfer plates 11, the heat is transferred to the body 9 through the plate bodies 49 and the heat conductors 51. Then, the heat exchange is conducted between the body 9 and the fluid to be heat-exchanged flowing inside the passage 23, whereby the fluid to be heat-exchanged is heated (FIG. 5).

At this time, the heat exchanger 7 improves the heat conductivity by the heat conductors 51 reaching the inside of the body 9 to realize the high heat exchange efficiency.

Further, according to this embodiment, the turning paths 33 of the passage 23 generate turbulent flows in the fluid to be heat-exchanged due to the angles 43 on the downstream side of the bent portions 35 as illustrated in FIG. 9. The fluid to be heat-exchanged, therefore, becomes brisk in the heat transfer between a low density portion and a high density portion and the heat is efficiently transferred between the inner surface of the passage 23 and the fluid to be heat-exchanged. This realizes higher heat exchange efficiency.

Further, according to this embodiment, the wall-shaped heat conductors 51 are located along the parallel paths 31 of the passage 23 in which the turbulent flows are generated. The wall-shaped heat conductors, therefore, effectively heat the portions at which the heat is efficiently transferred between the fluid to be heat-exchanged and the inner surface of the passage 23. This realizes still higher heat exchange efficiency.

Further, since the heat conductors 51 are formed into the wall shape, the heat exchanger 7 of this embodiment as a whole, according to its size, enables a surface area of the heat conductors 51 to be enlarged up to about four times larger than of the conventional heat conductors having a cylindrical pin shape. Not only does this prevent reduction of the heat exchange efficiency, but this also realizes high heat exchange efficiency.

At this heat exchange, though the heat transfer plates 11 and the body 9 expand according to the heat, the thermal expansion difference is absorbable with the presence of the gaps G1, G2 and G3 illustrated in FIGS. 8(A) and (B) to prevent crack generation in the passage 23.

In particular, the heat transfer plates 11 expand so as to fill the gaps G1, G2 and G3 to absorb the thermal expansion difference relative to the body 9 even if the heat transfer plates 11 are made of material having higher thermal expansion coefficient than of the body 9. Moreover, the filling of the gaps G2 and G3 improves the degree of contact between the heat conductors 51 and the holes 25 of the body 9 to enable the heat exchange efficiency to be adjustable.

Outlet temperatures relative to a preset temperature were compared between the embodiment 1 and a comparative example. The comparative example employed a plurality of heat conductors having a cylindrical pin shape following WO2013/180047 instead of the respective wall-shaped heat conductors 51 of the embodiment 1.

As the outlet temperatures, temperatures of the fluid to be heat-exchanged were measured at the outlet of the heat exchanger in a case where a flow rate of the fluid to be heat-exchanged was set to 10 L/min and preset temperatures of the heater plates were 100 degrees Celsius, 200 degrees Celsius, 300 degrees Celsius, 400 degrees Celsius, and 500 degrees Celsius.

Similarly, the embodiment 1 and the comparative example were compared with each other in a case where the flow rate of the fluid to be heat-exchanged was set to 1 L/min.

Figure 11A:
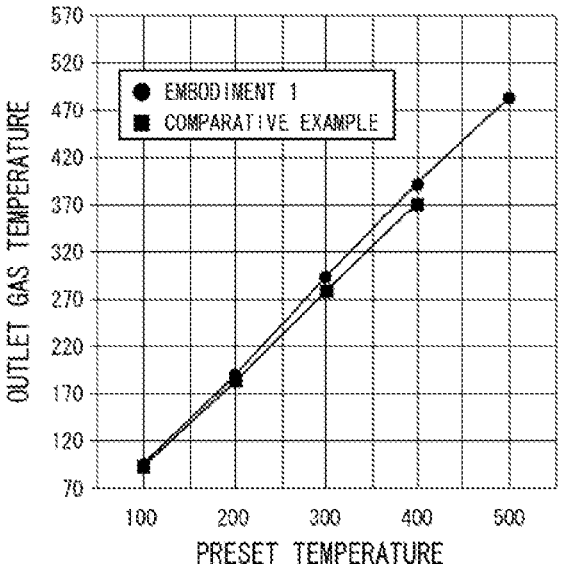
FIG. 11(A) is a graph plotted according to the result of FIG. 10(A) and FIG. 11(B) is a graph plotted according to the result of FIG. 10(B).

The comparison results are illustrated in FIGS. 10 and 11. FIGS. 10(A) and (B) are tables illustrating measurement results of the embodiment 1 and the comparative example by comparison, in which FIG. 10(A) is the case of the flow rate being 10 L/min and FIG. 10(B) is the case of the flow rate being 1 L/min. FIGS. 11(A) and (B) are graphs plotted according to the results of FIGS. 10(A) and (B), respectively.

As illustrated in FIGS. 10(A) and 11(A), in the case of the flow rate being 10 L/min, no marked difference is found between the embodiment 1 and the comparative example. The comparative example, therefore, is capable of obtaining a heat exchange rate equivalent to the embodiment 1 in the flow rate of 10 L/min. The heat exchange rate is a rate of the outlet temperature relative to the temperature of the heater plate (the same applies to the following).

Figure 11B:
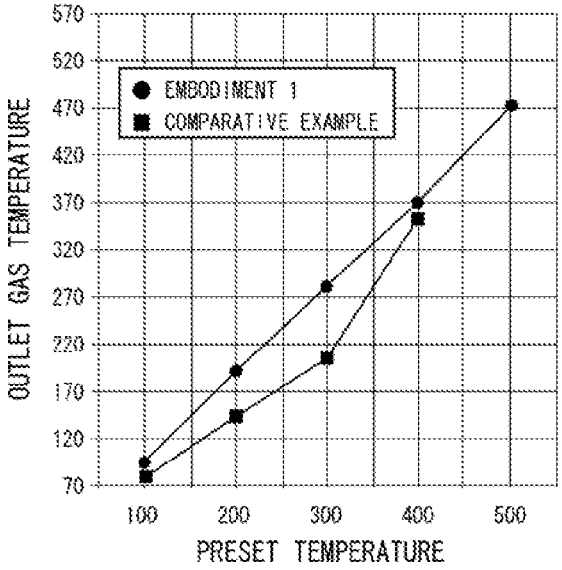

When applying the embodiment 1 and the comparative example to the case of the flow rate being 1 L/min, it is found that the comparative example drops relative to the embodiment 1 in the heat exchange rate in 100-400 degrees Celsius as illustrated in FIGS. 10(B) and 11(B). In particular, at the preset temperature of 300 degrees Celsius, the heat exchange rate remarkably falls below 70%.

The comparative example, therefore, could not keep the heat exchange rate according to the change in the flow rate of the fluid to be heat-exchanged whereas the embodiment 1 realized the high heat exchange efficiency and kept the high heat exchange rate regardless of the flow rate of the fluid to be heat-exchanged.

Figure 12:
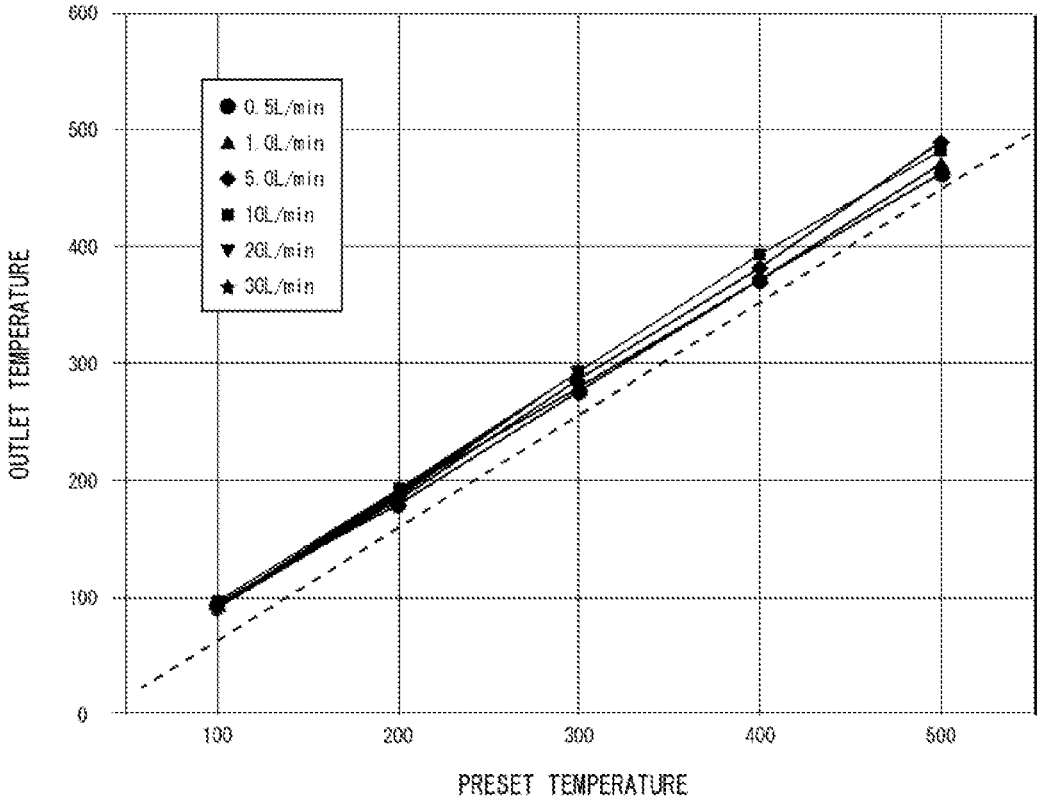
FIG. 12 is a graph illustrating outlet temperatures relative to a preset temperature at different flow rates of the fluid to be heat-exchanged by comparison according to the embodiment 1.

This is apparent from FIG. 12. FIG. 12 is a graph illustrating heat exchange rates at different flow rates of the fluid to be heat-exchanged by comparison for the embodiment 1. In FIG. 12, the dotted line is a line of the heat exchange rate 90%. As illustrated in FIG. 12, according to the embodiment 1, the heat exchange rate exceeds 90% at any flow rates of 0.5 L/min, 1 L/min, 5 L/min, 10 L/min, 20 L/min, and 30 L/min.

Figure 13A:
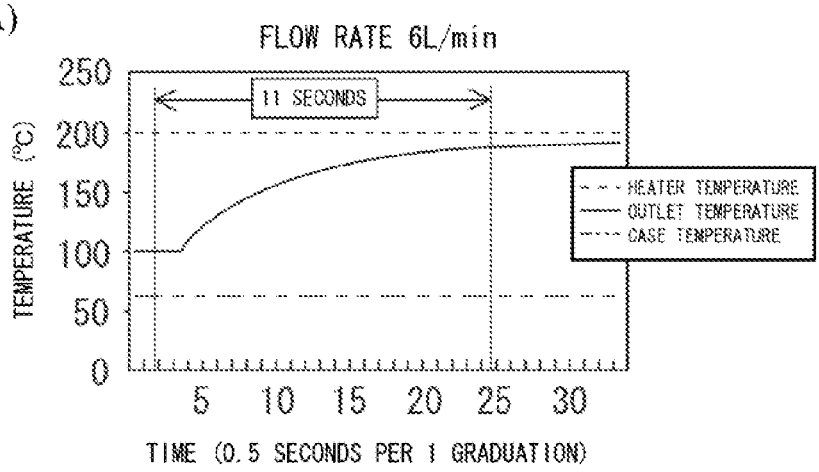
FIG. 13(A) is a case of a flow rate of the fluid to be heat-exchanged being 6 L/min.
Figure 13B:
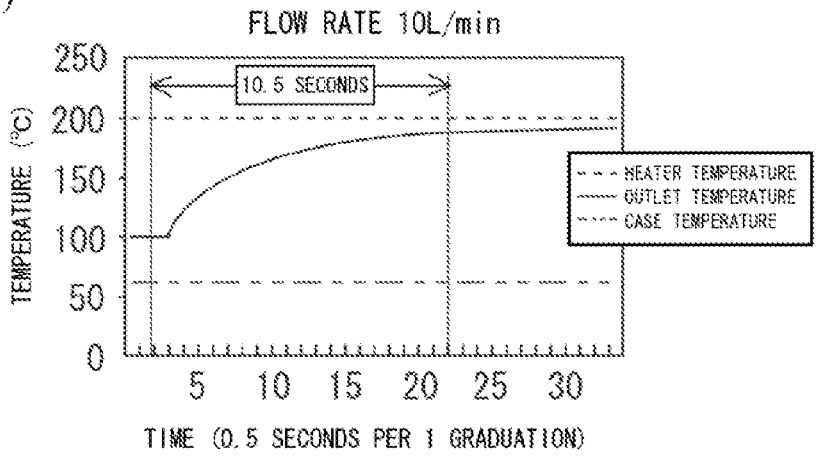
FIG. 13(B) is a case of a flow rate of the fluid to be heat-exchanged being 10 L/min.
Figure 13C:
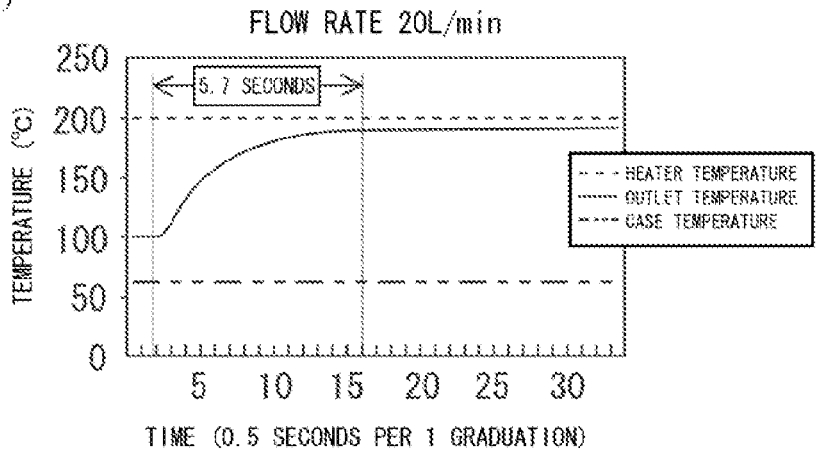
FIG. 13(C) is a case of a flow rate of the fluid to be heat-exchanged being 20 L/min.

Time required for stabilizing the outlet temperature around 200 degrees Celsius when rising from 100 degrees Celsius using the heat exchanger 7 of the embodiment 1 was measured as a response in cases where a temperature of the heater plates 13 was set to 200 degrees Celsius and a flow rate was set to 6 L/min, 10 L/min, and 20 L/min. FIGS. 13(A)-(C) are results of the flow rates being 6 L/min, 10 L/min, and 20 L/min, respectively.

As illustrated in FIGS. 13(A)-(C), in the case of the flow rate being 6 L/min, the response was 11 seconds, in the case of the flow rate being 10 L/min, the response was 10.5 seconds, and in the case of the flow rate being 20 L/min, the response was 5.7 seconds.

In the comparative example, the response was about 50 seconds at any flow rates. The embodiment 1, therefore, greatly improves the response by realizing the high heat exchange rate.

Further, in the embodiment 1, as illustrated in FIGS. 13(A)-(C), the case temperature was stable at 60-70 degrees Celsius similar to the comparative example in spite of heat insulation being reduced. It was, therefore, confirmed that the embodiment 1 improved in the heat exchange efficiency relative to the comparative example.

The heat exchanger 7 of this embodiment is provided with the body 9 having the passage 23 through which the fluid to be heat-exchanged passes, the heat transfer plate 11 conducting the heat exchange relative to the fluid to be heat-exchanged through the body 9. The heat transfer plate 11 has the plate body 49 with the contact face 49*a* that contacts the outer surface 9*a* of the body 9, and the plurality of the wall-shaped heat conductors 51 being protruded from the contact face 49*a* of the plate body 49 and arranged inside the body 9. The body 9 has the plurality of the slit-shaped holes 25 into which the plurality of the wall-shaped heat conductors 51 are inserted and fitted at the positions avoiding the passage 23, respectively, thereby to cause the heat conductors to be arranged inside the body. Each one heat conductor 51 is formed smaller than the hole 25 fitted, to define the gap G1, G2 or G3 relative to said hole 25 fitted.

The heat exchanger 7 of this embodiment, therefore, in the structure in which the heat conductor 51 is fitted into the hole 25 of the body of the heat exchanger 7, absorbs thermal expansion difference between the heat conductor 51 and the body 9 by the gap G1, G2 or G3 and prevents cracks from being generated in the passages 23.

Further, according to the heat exchanger 7 of this embodiment, not only does the heat conductor 51 wall-shaped prevent reduction of the heat exchange efficiency, but the heat conductor also improves the heat exchange efficiency, even if the heat conductor 51 is smaller than the hole 25.

As a result, this embodiment copes with different flow rates of the fluid to be heat-exchanged while maintaining the high heat exchange rate and remarkably improves the response of the change in temperature of the fluid to be heat-exchanged relative to the heater temperature of the heat exchanger 7.

The heat conductors 51 of this embodiment are formed smaller than the holes 25 in the dimension along the inserting direction to define the gaps G1, respectively. Thus, the gaps G1 allow the thermal expansion difference to be surely absorbed between the heat conductors 51 and the body 9.

Further, according to this embodiment, the heat conductor 51 is smaller than the hole 25 in the cross section along the intersecting direction relative to the inserting direction to define the gaps G2 and G3. The gaps G2 and G3, therefore, are filled when absorbing the thermal expansion difference between the heat conductor 51 and the body 9, thereby to improve the contact between the heat conductor 51 and the body 9 and enable the heat exchange efficiency to be adjustable.

According to this embodiment, the hole 25 is provided so as to pass completely through the body 9, the pair of the heat transfer plates 11 are provided across the body 9, the mutually corresponding heat conductors 51 of the pair of the heat transfer plates 11 are inserted into the same hole 25 from both sides to define the gap G1 between the mutually corresponding heat conductors 51.

This embodiment, therefore, arranges the heat transfer plate 11 on each side of the body 9 to surely conduct the heat exchange.

The heat conductors 51 of this embodiment are formed integrally with the plate body 49 and therefore are easily assembled to the body 9.

The passage 23 is provided with the parallel paths 31 arranged in parallel and the turning paths 33 having the turning-back shape and connecting the parallel paths 31. The heat conductors 51 are arranged along and between the parallel paths 31 of the passage 23.

According to this embodiment, therefore, the wall-shaped heat conductors 51 are effectively arranged relative to the passage 23.

Further, according to this embodiment, the turning path 33 has the bent shape with the angle 43 on the inside of the turning-back shape. The turbulent flows, therefore, are generated in the fluid to be heat-exchanged by the angle 43 on the downward side, the fluid to be heat-exchanged becomes brisk in the heat transfer between a low density portion and a high density portion, and the heat is allowed to be efficiently transferred between the inner surface of the passage 23 and the fluid to be heat-exchanged. This realizes the higher heat exchange efficiency.

Further, according to this embodiment, the wall-shaped heat conductors 51 are located along the parallel paths 31 of the passage 23 in which the turbulent flows are generated and therefore effectively heat the portions at which the heat transfer is efficiently conducted between the fluid to be heat-exchanged and the inner surface of the passage 23. This realizes the still higher heat exchange efficiency.

Further, according to this embodiment, the turning path 33 is the bent shape having the curved face 45 with no angle on the outside of the turning-back shape and therefore excessive turbulent flows are prevented to suppress pressure loss of the fluid to be heat-exchanged.

Figure 14:
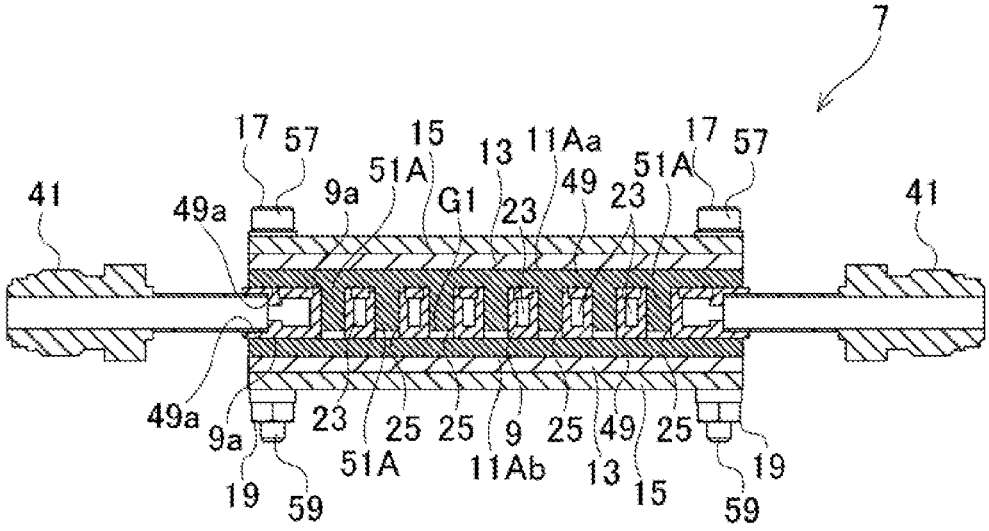
FIG. 14 is a sectional view of a heat exchanger according to an embodiment 2 of the present invention.

FIG. 14 is a sectional view of a heat exchanger according to this embodiment 2 of the present invention. In the embodiment 2, components corresponding to of the embodiment 1 are represented using the same reference numerals or the same reference numerals with A to avoid repetition in the description.

A heat exchanger 7A of this embodiment has heat conductors 51A that are provided only on one heat transfer plate 11Aa of a pair of heat transfer plates 11Aa and 11Ab. The heat transfer plate 11Ab has no heat conductors and comprises a plate body 49 only.

The heat conductor 51A is longitudinally elongated relative to the embodiment 1 so that a gap G1 is defined between the heat conductor and the other heat transfer plate 11Ab in an inserting direction.

The embodiment 2 also provides the same effect as the embodiment 1.

Figure 15:
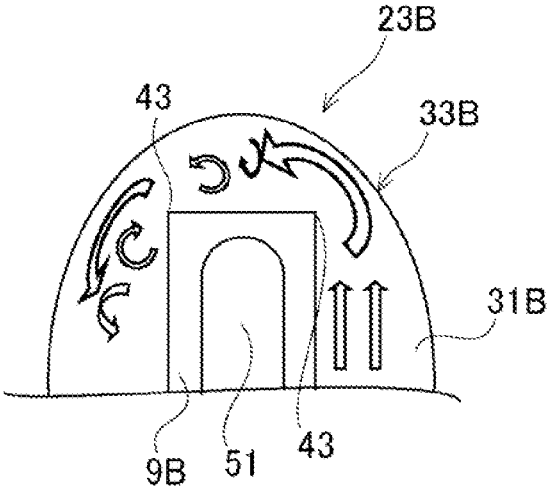
FIG. 15 is a conceptual view illustrating part of a passage of a body of a heat exchanger according to an embodiment 3 of the present invention.

FIG. 15 is a conceptual view illustrating part of a passage of a body of a heat exchanger according to the embodiment 3 of the present invention. In the embodiment 3, components corresponding to of the embodiment 1 are represented using the same reference numerals or the same reference numerals with B to avoid repetition in the description.

This embodiment forms an outside of a turning-back shape of turning paths 33B of a passage 23B entirely into a curved shape with no corner.

The embodiment 3, therefore, generates turbulent flows by an angle 43 on an inside of the turning-back shape of the turning path 33B and more surely prevents excessive turbulent flows by the entirely curved shape with no corner on the outside of the turning-back shape. Accordingly, this embodiment surely generates the turbulent flows while suppressing pressure loss of fluid to be heat-exchanged to a minimum.

In addition, the embodiment 3 provides the same effect as the embodiment 1.

Figure 16:
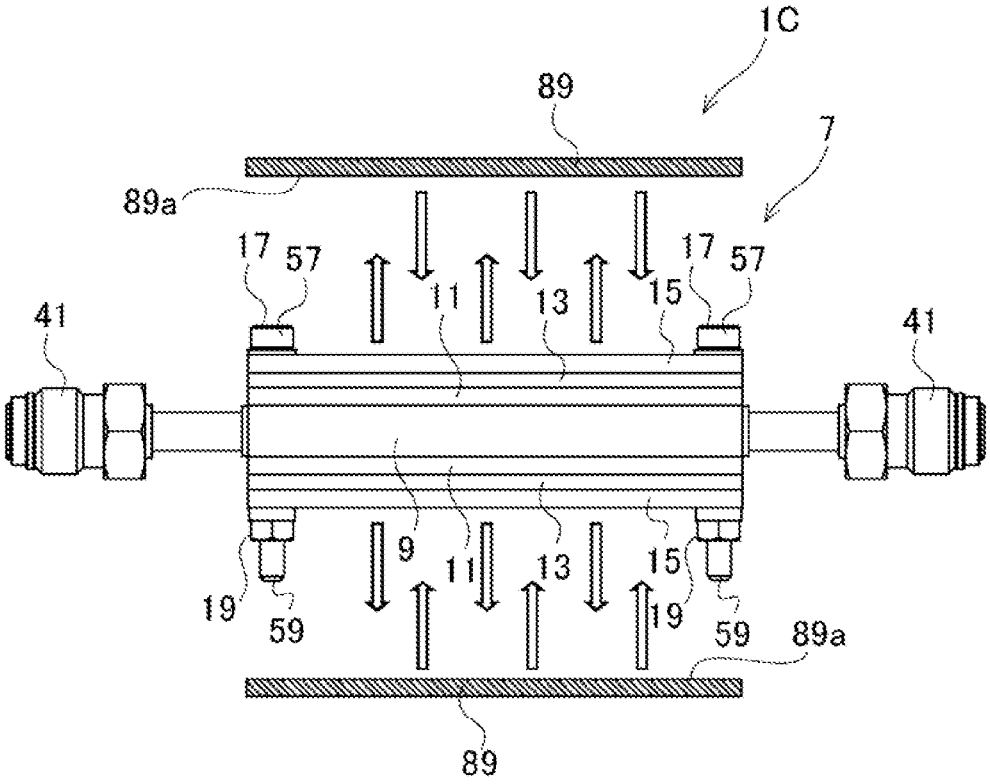
FIG. 16 is a side view schematically illustrating a heat exchanging unit according to an embodiment 4 of the present invention.

FIG. 16 is a side view illustrating a partly cross-sectioned heat exchanging unit having a heat exchanger according to this embodiment 4 of the present invention. In the embodiment 4, components corresponding to of the embodiment 1 are represented using the same reference numerals or the same reference numerals with C to avoid repetition in the description. In addition, indication of a case 5 is omitted in FIG. 16.

A heat exchanging unit 1C has reflecting members 89 arranged around a heat exchanger 7. The reflecting member 89 has an inner face 89*a* facing the heat exchanger 7 and being mirror-finished so that it reflects radiant heat from the heat exchanger 7 to improve heat exchange efficiency of the heat exchanger 7.

The reflecting member 89 is formed of a metal plate, foil or the like. The reflecting member 89, however, may be configured by the case 5. In this case, an inner surface of the case 5 should be mirror-finished.

The embodiment 4, therefore, further improves the heat exchange efficiency of the heat exchanger 7. In addition, the embodiment 4 provides the same effect as the embodiment 1.

Figure 17:
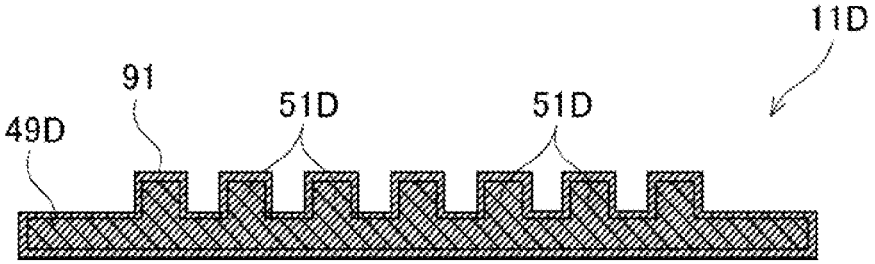
FIG. 17 is a sectional view illustrating a heat transfer plate used in a heat exchanger according to an embodiment 5 of the present invention.

FIG. 17 is a sectional view illustrating a heat transfer plate used in a heat exchanger according to this embodiment 5 of the present invention. In the embodiment 5, components corresponding to of the embodiment 1 are represented using the same reference numerals or the same reference numerals with D to avoid repetition in the description.

A heat transfer plate 11D is made of copper and has a silver coating 91 formed on the surface.

If the heat transfer plate 11D is made of metal, aluminum is used as the material in general. Melting point of aluminum, however, is 660 degrees Celsius and is relatively low. There is a limit on raising of temperature of the heat exchanger.

By contrast, since the heat transfer plate 11D is made of copper which has a melting point being 1080 degrees Celsius and being relatively high, this embodiment can cope with the raising of the temperature of the heat exchanger. Copper, however, is a contaminant substance in some applications such as a semiconductor manufacturing process, and therefore this embodiment applies the coating 91 of silver that is a non-contaminant substance on the surface of the heat transfer plate 11D made of copper. It should be noted that the non-contaminant substance is not limited to silver and appropriate material may be employed according to an application of the heat exchanger.

The invention claimed is:

1. A heat exchanger comprising:

a body having a passage through which fluid to be heat-exchanged passes;

a heat transfer member conducting heat exchange relative to the fluid to be heat-exchanged through the body, wherein the passage comprises a wave shape between ends of the body in a plan view and has turning paths corresponding to wave troughs and peaks of the wave shape and middle paths each arranged between respective turning paths to connect respective turning paths corresponding to wave troughs with respective turning paths corresponding to wave peaks, the body has slit-shaped holes at positions spaced from the passage, the slit-shaped holes each having a first dimension in a first direction along at least one of the middle paths and a second dimension in a second direction intersecting the first direction in plan view in which the first dimension is larger than the second dimension, and the heat transfer member is provided with a member body having a contact face that contacts an outer surface of the body, and a plurality of wall-shaped heat conductors protruding from the contact face of the member body, inserted and fitted into the slit-shaped holes, respectively and each having a first hole dimension in the first direction and a second hole dimension in the second direction in which the first hole dimension is larger than the second hole dimension, each one heat conductor is formed smaller than the respective hole in which said each one heat conductor is inserted and fitted, to define a gap relative to said hole, each of the holes is a single hole formed so as to pass through the body in a third direction intersecting the first and the second directions and having openings on respective outer faces of the body in the third direction, a pair of heat transfer members each being said heat transfer member are provided across the body in the third direction so that mutually corresponding heat conductors are inserted into a corresponding hole of said holes from both openings to define the gap in the third direction between front ends of said mutually corresponding heat conductors and the corresponding hole, and the front ends of the mutually corresponding heat conductors face each other with insertion of only the gap in the third direction.

2. The heat exchanger according to claim 1, wherein the heat conductors are formed integrally with the member body.

3. The heat exchanger according to claim 1, wherein the heat conductors are formed smaller than the holes in a cross section along the first and second directions to define the gaps in the first and second direction, respectively.

4. The heat exchanger according to claim 1, wherein the middle paths are arranged in parallel and the turning paths have a turning-back shape and connect the middle paths, and the heat conductors are arranged along and between the parallel middle paths of the passage.

5. The heat exchanger according to claim 4, wherein each turning path has a bent shape with an angle on an inside of the turning-back shape.

6. The heat exchanger according to claim 5, wherein each turning path has a curved shape with no angle on an outside of the turning-back shape.

7. The heat exchanger according to claim 1, wherein the mutually corresponding heat conductors in the corresponding hole are configured to expand so as to fill the gap in the third direction at the time of the heat exchange.

8. The heat exchanger according to claim 1, wherein the second dimension of each of the heat conductors in the second direction is larger than a dimension of the middle path of the passage in the second direction.

9. A heat exchanger comprising:

a body having a passage through which fluid to be heat-exchanged passes;

a heat transfer member conducting heat exchange relative to the fluid to be heat-exchanged through the body;

the heat transfer member being provided with a member body having a contact face that contacts an outer surface of the body, and a plurality of wall-shaped heat conductors protruding from the contact face of the member body and arranged inside the body;

the body being provided with a plurality of slit-shaped holes into which the plurality of wall-shaped heat conductors is inserted and fitted at positions avoiding the passage, respectively, thereby to cause the heat conductors to be arranged inside the body; wherein each one heat conductor is formed smaller than the hole in which said each one heat conductor is inserted and fitted, to define a gap relative to said hole fitted, each of the holes is a single hole formed so as to pass through the body in a third direction intersecting the first and the second directions and having openings on respective outer faces of the body in the third direction, a pair of heat transfer members each being said heat transfer member are provided across the body in the third direction so that mutually corresponding heat conductors are inserted into a corresponding hole of said holes from both openings to define the gap in the third direction between front ends of said mutually corresponding heat conductors and the corresponding hole, and the front ends of the mutually corresponding heat conductors face each other with insertion of only the gap in the third direction.

* * * * *